United States Patent [19]

Hoerlein

[11] Patent Number: 4,488,315

[45] Date of Patent: Dec. 18, 1984

[54] COMBINATION SCARF AND PUPPET

[76] Inventor: Francesca S. Hoerlein, 701 S. 2nd St., Fairfield, Iowa 52556

[21] Appl. No.: 437,496

[22] Filed: Oct. 28, 1982

[51] Int. Cl.[3] ..... A41D 23/00

[52] U.S. Cl. ..... 2/91

[58] Field of Search ..... 2/91; 46/154, 158

[56] References Cited

U.S. PATENT DOCUMENTS

| | | | |
|---|---|---|---|
| 1,075,244 | 10/1913 | Epstein | 2/66 |
| 3,308,479 | 3/1967 | Sesco, Jr. | 46/154 |
| 3,447,165 | 6/1969 | Brosk | 46/154 |
| 3,557,436 | 1/1971 | Hodes | 46/158 |
| 3,942,283 | 3/1976 | Rushton | 46/154 |

*Primary Examiner*—Doris L. Troutman

*Attorney, Agent, or Firm*—Lyon & Lyon

[57] ABSTRACT

The invention relates to an article of apparel and comprises a flexible elongated scarf being dimensioned such that it is supportable around a wearer's neck. In addition one or both ends are constructed such to represent a hand puppet including a body with a skirt element. Part of the puppet's usefulness is in developing dexterity.

10 Claims, 3 Drawing Figures

COMBINATION SCARF AND PUPPET

DISCLOSURE OF THE INVENTION

The present invention relates to wearing apparel and children's toys in combination, specifically, a combination scarf and hand puppet.

Puppets have long been known for their amusement value to children and others. Various forms of puppets have been in use for many years, including string-supported marionettes, large ventriloquist dummies, and small hand puppets.

Part of a puppet's usefulness is in developing dexterity. Ventriloquist dummies are too large and cumbersome for routine play. While marionettes are effective in developing dexterity, their complexity usually only creates frustation. The smaller hand puppets are consequently, especially valued by children because of their convenience and ease of operation.

While the simplicity of small state of the art hand puppets are virtues, they also are the cause of many drawbacks. State of the art hand puppets are easy to operate, but are too simple to aid in the development of dexterity.

Another problem with the present state of the art in hand puppets is that due to their small size, they tend to be easily lost by exuberant and sometimes forgetful, young children. This results in great dismay to the child and great expense to the parent. Furthermore, typical hand puppets, lacking a body, are limited in their play value because even to an imaginative young child, a puppet without a body member is too easily recognized as being only a puppet, rather than an imaginary playmate.

Scarves and mittens have been in use by adults and children for many years and in cold climates are considered an essential article of wearing apparel. But children especially tend to be forgetful about wearing such things, often leaving their scarves at school or where they have put them down to play frequently catching colds as a result.

There is consequently a need for a hand puppet toy large enough not to be easily lost and still small enough to be conveniently carried and used and also challenging enough to help develop dexterity, while not being so complicated that it creates frustration. There is further a need for a scarf that children, especially, will more readily wear, and which can serve the function of a pair of mittens when necessary.

STATEMENT OF THE INVENTION

The invention provides a hand puppet toy which is less easily lost because of its larger size than state of the art hand puppets, and because it can be carried on the child's neck.

The invention further provides a hand puppet toy with a single body that could be used by at least two children simultaneously.

Still further there is provided a hand puppet toy with progressive levels of difficulty for aiding in dexterity development while remaining simple enough to avoid frustrations.

The invention also provides a hand puppet which can be supported around the child's neck, either while in use or while not in use.

Yet further there is provided a scarf, primarily for use by a child, which includes fanciful hand puppets towards its ends to increase the likelihood that the scarf will be worn by the child and to decrease the likelihood of its being lost.

DETAILED DESCRIPTIONS OF THE PREFERRED EMBODIMENTS

Figure 1:
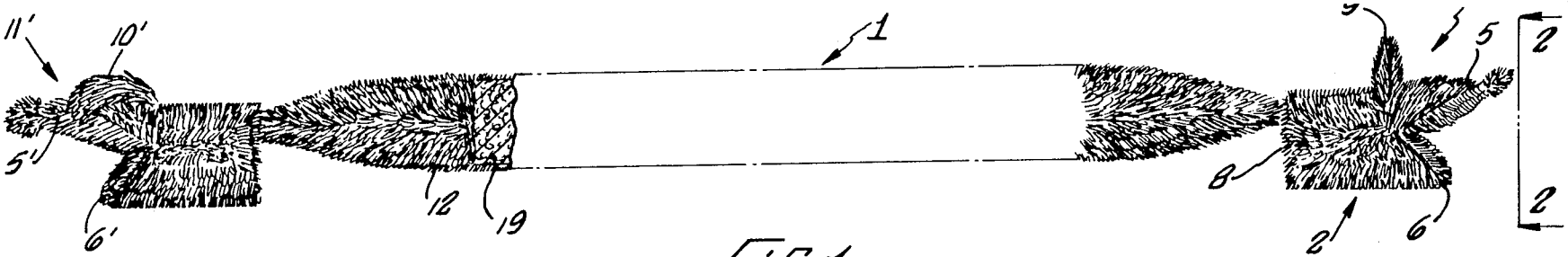
FIG. 1 is an elevation of a puppet in accordance with this invention.

The article of FIG. 1 shows an elongated puppet toy with whimsical, manipulable hand puppets, 2 and 2' at each end approximately representing dogs' faces. The invention is not limited to any particular type of animal, human, or imaginary figure, as there are an infinite variety of other figures which would serve as well. The parts of the hand puppets 2 and 2' will be referred to as those of a dog's face merely for ease of explanation.

Figure 2:
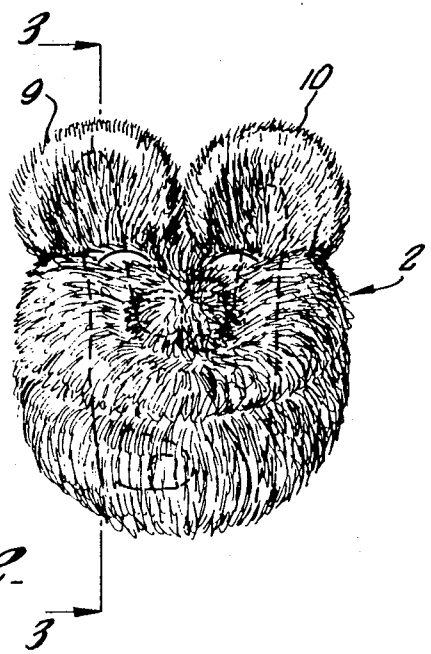
FIG. 2 is a front view of one of the puppet ends of the invention along line 2—2 of FIG. 3 with a hand shown in phantom in an operating position.

The puppet toy as represented in FIG. 1 includes a flexible elongated member 1 in the form of a general tubular body, to the right of which is mounted a central hollow elongated tubular member 11 resembling a dog's head, and to the front of which in turn is mounted an upper hollow appendage 5 and a lower hollow appendage 6 resembling a dog's chin in opposition to the upper hollow appendage 5. Attached at the upper side of the central hollow member 11 are two hollow upwardly projecting hollow fingerstalls 9 and 10, in the shape of erect dog's ears. Only fingerstall 9 is shown in the FIG. 1 side view for clarity. Both are shown in FIG. 2.

Figure 3:
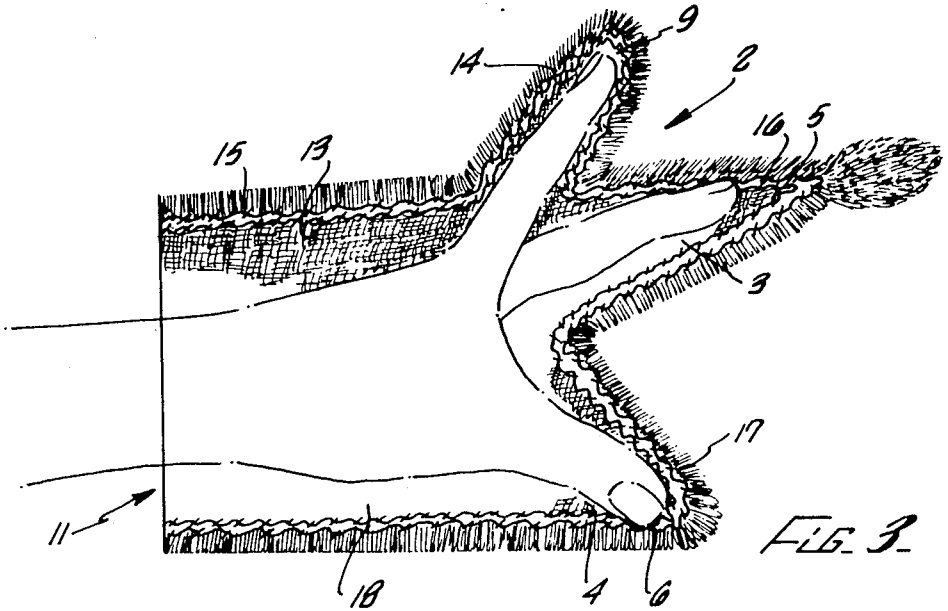
FIG. 3 is a sectional side view as taken on line 3—3 of FIG. 1 with a hand shown in typical operating position.

Referring now to FIG. 3, it will be seen that the upward projecting hollow fingerstalls 9 and 10 each define finger cavities 3 and 4 respectively, which open into the internal cavity 18 formed by the central hollow member 11, as skirt to the body of puppet and allowing the wearer's fingers to be inserted into the puppet body. Only upwardly extending hollow fingerstall 9 is shown for clarity. The upper hollow appendage 5 forms a cavity 3 opening into the cavity 18 formed by central hollow portion 11 allowing insertion of one or more of the wearer's fingers. The lower hollow appendage 6 also forms a cavity 4 allowing insertion of one or more of the wearer's fingers.

Referring again to FIG. 1, an opening 8 is provided into the central hollow member 11.

The hand puppet shown at the left of FIG. 1 is similarly constructed, but is shown with the upwardly projecting hollow fingerstalls 9 and 10 representing a dog's ears in the flacid position. The parts are labelled corresponding to the right side hand puppet; central hollow member 11, upper hollow appendage 5', lower hollow appendage 6' and upwardly projecting hollow fingerstalls 9' and 10', only 10' of which is shown for clarity. The flexible elongated member 1 is shown with a soft, fuzzy covering 12, although any material may be used; and with a soft stuffing material 19 inside, although it is not necessary to the invention that it be stuffed.

Referring now to FIG. 3, the upwardly projecting hollow fingerstall 9 is shown with a soft, fuzzy covering 14, but it is not necessary to the invention that it be so covered. The central hollow portion 11 is also shown with a soft, fuzzy covering 15, but it is not necessary to the invention that it be so covered. Upper hollow appendage 5 and lower hollow appendage 6 were each shown with soft, fuzzy covering 16 and 17 respectively, but it is not necessary to the invention that they be so covered. The inside of hand puppet 2 is shown with internal, insulating lining 13.

FIG. 2 shows the front end view of hand puppet 2, better indicating a possible position of upwardly extending hollow fingerstalls 9 and 10, although other upper side mounting positions are possible and intended. FIG. 3 shows a hand in phantom with fingers inserted into the various cavities in one of the most challenging operating positions. When the upper hollow appendage 5 and lower hollow appendage 6 are brought together by closing the thumb towards the other fingers, the appearance of a closing mouth may be achieved. In the most challenging operating position, fingers may also be inserted into either or both of the upwardly projecting hollow fingerstalls 9 and 10 to enable wiggling of these upwardly extending hollow fingerstalls 9 and 10. When all fingers are moved simultaneously, a very challenging operating condition is achieved.

The puppet heads, themselves are manipulated by the entire hand of the wearer so that the face of the puppet can be manipulated into any facial expression depending on the position of the wearer's hands and fingers.

In one embodiment of the invention, the head of the hand puppet will cover only the wearer's hand to the wrist but not including the wrist. This will provide the maximum ease of operation for the child.

In another embodiment of the invention, the child's hands will slip inside a portion of the tubular elongated member connecting the hand puppets, covering beyond the wearer's wrist and at least part of the child's arm. This will allow the child to impart a life-like movement to the neck of the puppet, increasing the puppet's amusement value and also providing more warmth to the child's hand and arm when needed in place of mittens.

The article can be made out of any suitable material, and the choice of material will depend largely upon whether it is desired that the proposed article assumes more of the qualities of a scarf or tend to assume more of the qualities of the hand puppet. In colder climates, suitable materials might be materials such as Orlon or wool for the elongated member of the invention to increase its warmth. The hand puppet portion may be made out of any suitable material, either a continuation of elongated member material shaped into a fanciful puppet head or perhaps a fuzzy, animal fur-like material. The elongated member material could also be made out of the same animal fur-like material of the fanciful puppet heads. The elongated member of the invention may also be stuffed with a suitable material to increase its bulk and to give it more of the appearance of a body of the puppet.

This invention thus can provide the utility of a scarf combined with the amusement value of a hand puppet, including many improvements over state of the art hand puppets. The addition of the elongated member provides a body for the hand puppets, thereby adding more realism and increasing their amusement value to children. It further increases the size of the hand puppet so that it will be less likely to be easily lost by a forgetful child. Further, the elongated member may be placed around the neck of the wearer, thus providing a ready place for the child to carry the toy whether it is in use or not, and providing warmth when necessary. The elongated member may also have a soft outer covering imparting cuddly and warm feeling to the toy, thereby increasing the child's enjoyment.

Furthermore, the adaption of two hand puppets at opposite ends of the same body is itself unique, and this combination will increase the enjoyment to children when playing in conjunction with another playmate because both children will be able to operate the same hand puppet simultaneously thereby increasing their friendship and their spirit of cooperation.

As an improvement on a scarf, the addition of the hand puppets makes it more valuable to a child, thereby increasing the likelihood that the scarf will be worn in cold climates and decrease the likelihood it will be lost or forgotten.

Without further analysis, the foregoing so fully reveals the gist of the invention that others can, by applying current knowledge, readily adapt it for various applications without omitting features that, from the standpoint of the prior art, fairly constitute essential characteristics of the generic or specific aspects of this invention and, therefore, such adaptions should and are intended to be comprehended within the meaning and range of the equivalents of the following claims.

What is claimed is:

1. An article comprising a flexible elongated scarf with two free ends, said elongated scarf being dimensioned such that it is supportable around the wearer's neck, at least one hand puppet mounted towards one of the free ends of the flexible elongated scarf, said hand puppet including a body with a skirt element containing an internal cavity dimensioned larger than the hand of the wearer thereby to facilitate comfortable manipulation, said skirt including an external opening leading into said cavity, and said opening being dimensioned larger than the hand of the wearer thereby to permit substantially free insertion of the hand of the wearer into said cavity.

2. The article as claimed in claim 1 wherein the elongated scarf is an insulating scarf which imparts warmth to the wearer's neck.

3. The article as claimed in claim 1 including a tubular elongated member, said tubular elongated member having an opening leading to the cavity of the hand puppet thereby to cover at least the wrist and the hand of the wearer when the hand of the wearer is operably inserted into the hand puppet.

4. The article as claimed in claim 3, wherein the tubular elongated member constitutes part of the flexible elongated member.

5. The article as claimed in claim 4 including an insulating lining in the puppet head whereby warmth may be imparted to the wearer's hand.

6. The article as claimed in any one of claims 1 to 5 wherein the internal cavity includes a central hollow portion having an upper and a lower hollow appendage, each appendage being mounted towards the front of the internal cavity and being positioned opposite each other, said hollow appendages including an internal fingerstall dimensioned to facilitate insertion of at least one finger of the operator and said fingerstall opening into the internal cavity.

7. The article as claimed in claim 3, wherein tubular elongated member includes an external opening leading through the inside of the tubular elongated member and into the cavity of the hand puppet thereby to cover at least the wrist in addition to the hand of the wearer.

8. The article as claimed in anyone of claims 1 to 5 including puppet heads at both ends of the elongated scarf.

9. The article as claimed in claim 6 including puppet heads at both ends of the elongated scarf.

10. The article as claimed in claim 7 including puppet heads at both ends of the elongated scarf.

* * * * *